US007183979B1

(12) United States Patent
Liu et al.

(10) Patent No.: US 7,183,979 B1
(45) Date of Patent: Feb. 27, 2007

(54) DUAL-BAND PATCH ANTENNA WITH SLOT STRUCTURE

(75) Inventors: I-Ru Liu, Taipei (TW); Hong-Kun Tyan, Taoyuan Hsien (TW)

(73) Assignee: Accton Technology Corporation, Hsinchu (TW)

( * ) Notice: Subject to any disclaimer, the term of this patent is extended or adjusted under 35 U.S.C. 154(b) by 9 days.

(21) Appl. No.: 11/209,813

(22) Filed: Aug. 24, 2005

(51) Int. Cl.
*H01Q 1/38* (2006.01)

(52) U.S. Cl. ..... 343/700 MS; 343/846; 343/702

(58) Field of Classification Search ..... 343/700 MS, 343/846, 848, 702, 767, 770
See application file for complete search history.

(56) References Cited

U.S. PATENT DOCUMENTS 6,252,552 B1 * 6/2001 Tarvas et al. ..... 343/700 MS
6,346,914 B1 * 2/2002 Annamaa ..... 343/700 MS
6,498,586 B2 * 12/2002 Pankinaho ..... 343/700 MS
6,801,166 B2 * 10/2004 Mikkola et al. ..... 343/700 MS
2003/0189523 A1 * 10/2003 Ojantakanen et al. ..... 343/702
2003/0193438 A1 * 10/2003 Yoon ..... 343/702

* cited by examiner

*Primary Examiner*—Hoanganh Le
(74) *Attorney, Agent, or Firm*—Birch, Stewart, Kolasch & Birch, LLP

(57) ABSTRACT

A dual-band patch antenna with a slot structure is disclosed. The dual-band patch antenna comprises a metal-work antenna including a rectangular (patch) radiator on which an L-shaped slot structure is formed; two shorting strips and vertically shorted to a conductive ground plane formed on a base board; and a feeding means inserted into the base board. When the dual-band patch antenna is operated at about 2.45 GHz and about 5.4 GHz, good radiation pattern and antenna gain are obtained for being applicable to IEEE802.11*b*/*g*/a/j or Bluetooth specifications.

17 Claims, 9 Drawing Sheets

Return Loss

DUAL-BAND PATCH ANTENNA WITH SLOT STRUCTURE

FIELD OF THE INVENTION

The present invention relates to a patch antenna with a slot structure, and more particularly, to the dual-band patch antenna having an L-shaped slot structure.

BACKGROUND OF THE INVENTION

With the advancement of communication technologies, the applications using communication technologies have also increased significantly, thus making the related products more diversified. Especially, consumers have more demands on advanced functions from communication applications, so that many communication applications with different designs and functions have been continuously appearing in the market, wherein the computer network products with wireless communication functions are the main streams recently. Moreover, with integrated circuit (IC) technologies getting matured, the size of product has been gradually developed toward smallness, thinness, shortness and lightness.

An antenna in the communication products is an element mainly used for radiating or receiving signals, and the antennas used in the current wireless products have to own the features of small size, excellent performance and low cost, so as to be broadly accepted and confirmed by the market. According to different operation requirements, the functions equipped in the communication products are not all the same, and thus there are many varieties of antenna designs used for radiating or receiving signals, wherein a patch antenna is quite commonly used. In order to obtain an antenna with high gain and broadband operation, the distance between the base board and the radiating metal plate can be increased for promoting the radiation efficiency and the operation bandwidth of the antenna. Generally, the features of antenna can be known by the parameters of operation frequency, radiation pattern, return loss, and antenna gain, etc. Hence, the design of patch antenna has to simultaneously consider the factors of appropriate distance between the base board and the radiating metal plate, and good antenna features.

On the other hand, the conventional dual-band antennas merely can cover a relatively small frequency range, and thus can be used in respective specific areas. For example, the frequency bands used in Japan, Europe and USA are all different, and thus different dual-band antennas have to be used in various areas.

However, it is very difficult for the conventional patch antenna, especially for the conventional dual-band patch antenna, to simultaneously have the feature of wide frequency range with the advantages of low cost, small size, high antenna gain, broad operation bandwidth and good radiation pattern, so that the applications of the conventional patch antenna are greatly limited.

Hence, there is an urgent need to develop a dual-band patch antenna for satisfactorily meeting the antenna requirements of wide frequency range, small size, high gain, wide broadband, simple design, low cost and small second harmonic, etc., thereby overcoming the disadvantages of the conventional patch antenna.

SUMMARY OF THE INVENTION

In view of the invention background described above, since the conventional patch antenna cannot effectively satisfy the aforementioned antenna requirements; and can not be used in the areas of different frequency bands, the applications thereof are thus greatly limited.

In an aspect of the present invention, a dual-band patch antenna with a slot structure is provided for having the feature of wide frequency range so as to be applicable to various areas with different frequency bands.

In the other aspect of the present invention, a dual-band patch antenna with a slot structure is provided for meeting the requirements of smallness, thinness, shortness and lightness.

In accordance with the aforementioned aspects of the present invention, the present invention provides a dual-band patch antenna with a slot structure. According to a preferred embodiment of the present invention, the dual-band patch antenna with the slot structure comprises a rectangular radiator, a feeding means, a first shorting strip and a second shorting strip. The rectangular radiator has a first longer side, a second longer side parallel to the first longer side, a first shorter side, and a second shorter side parallel to the first longer side, and the slot structure is formed on the rectangular radiator. The slot structure is composed of a first linear slot and a second linear slot, wherein one end of the first linear slot is perpendicularly connected to the first shorter side, and one end of the second linear slot is perpendicularly connected to the other end of the first linear slot, and the second linear slot is located between the first linear slot and the first longer side. The feeding means is connected to a feed point located on the rectangular radiator, wherein the feed point is located between the first longer side and the other end of the second linear slot. The feeding means further has a fixing foot used for being firmly inserted into a base board, wherein the cross-section of the fixing foot is smaller than that of the feeding means. The first shorting strip is connected to a first short point located on the rectangular radiator, wherein the first short point is located on the corner formed from the first shorter side and the first linear slot, and is between the second linear slot and the first shorter side. The second shorting strip is connected to a second short point located on the rectangular radiator, wherein the second short point is adjacent to the second shorter side with a predetermined distance spaced from the first longer side, and the predetermined distance is substantially equal to the distance between the second linear slot and the second shorter side.

Hence, with the use of the present invention, the dual-band patch antenna can cover a wide frequency range, and meet the requirements of smallness, thinness, shortness and lightness.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
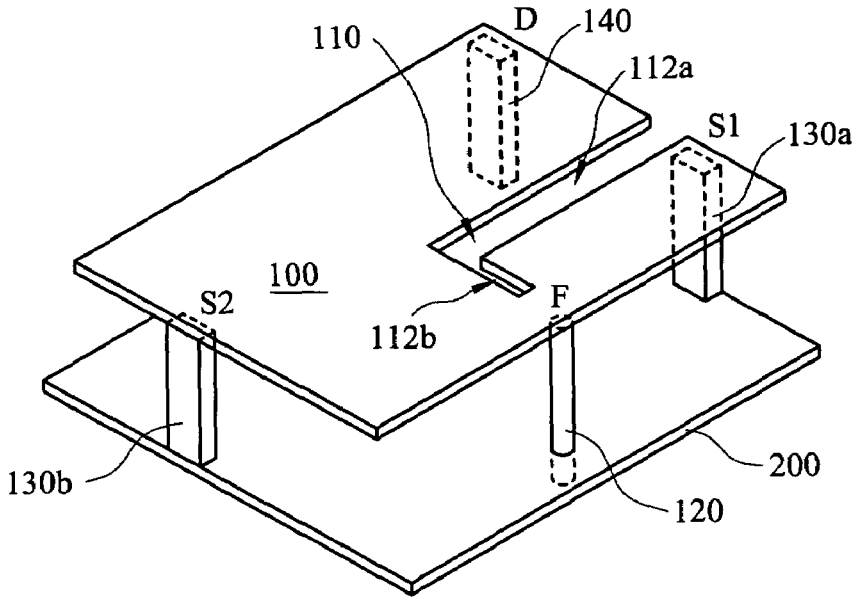
FIG. 1 is a schematic diagram showing the 3-D view of a dual-band patch antenna with a slot structure, according to a first preferred embodiment of the present invention.
Figure 2A:
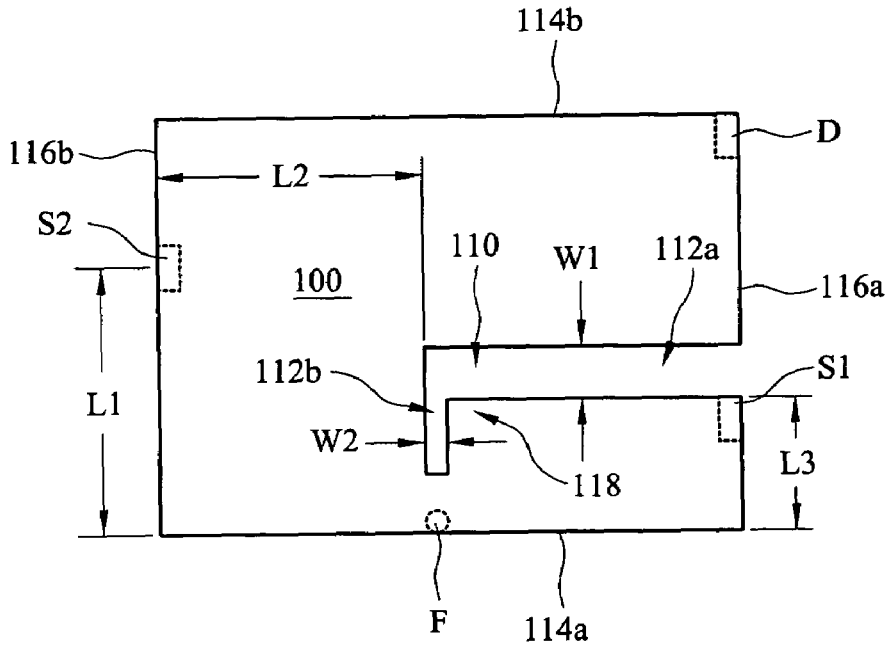
FIG. 2A is a schematic diagram showing the top view of the dual-band patch antenna with the slot structure, according to the first preferred embodiment of the present invention.
Figure 2B:
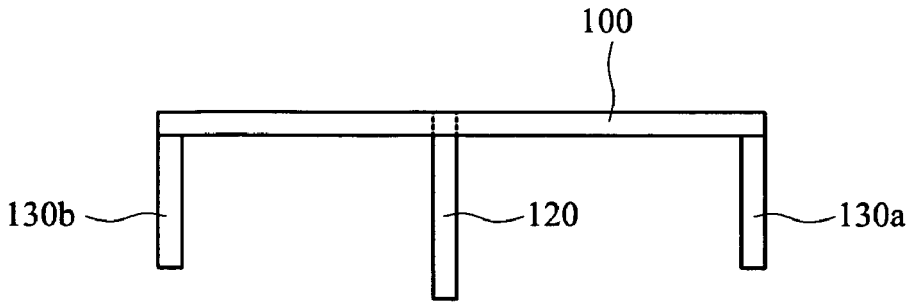
FIG. 2B is a schematic diagram showing the front view of the dual-band patch antenna with the slot structure, according to the first preferred embodiment of the present invention.
Figure 2C:
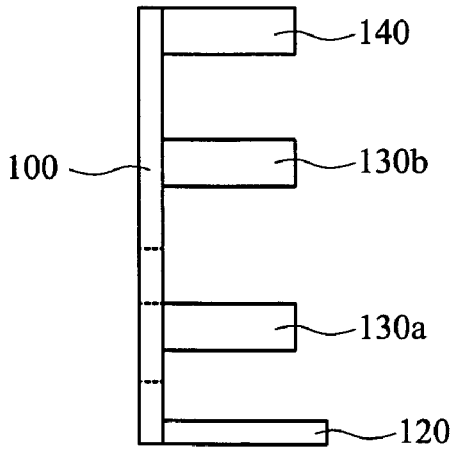
FIG. 2C is a schematic diagram showing the side view of the dual-band patch antenna with the slot structure, according to the first preferred embodiment of the present invention.
Figure 3:
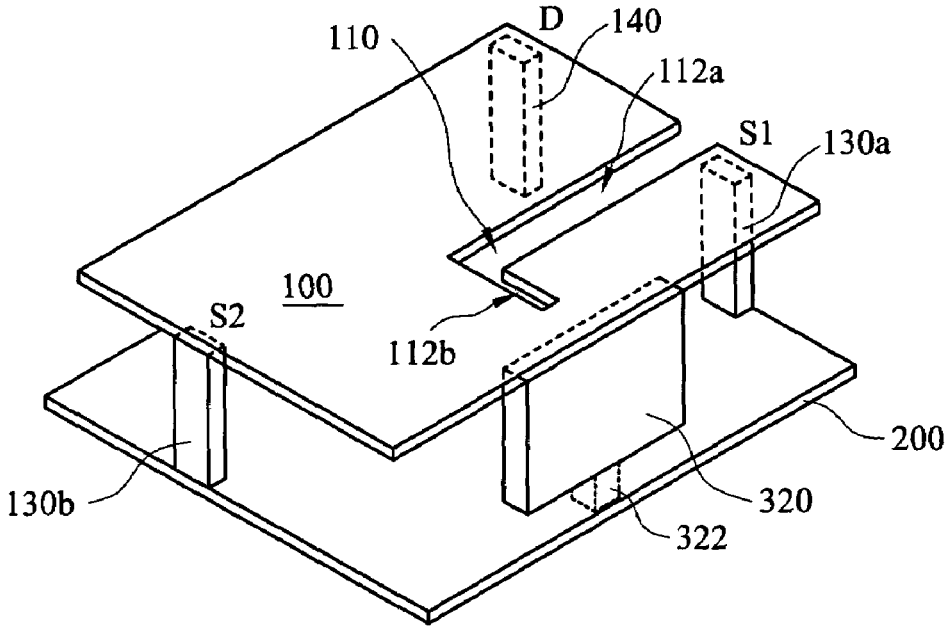
FIG. 3 is a schematic diagram showing the 3-D view of a dual-band patch antenna with the slot structure, according to a second preferred embodiment of the present invention.
Figure 4A:
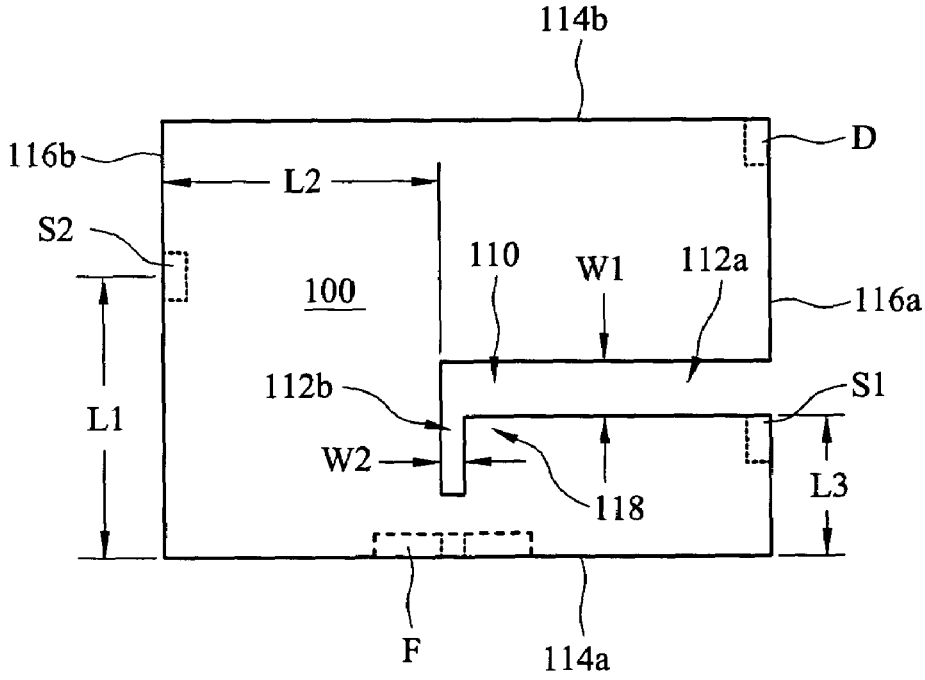
FIG. 4A is a schematic diagram showing the top view of the dual-band patch antenna with the slot structure, according to the second preferred embodiment of the present invention.
Figure 4B:
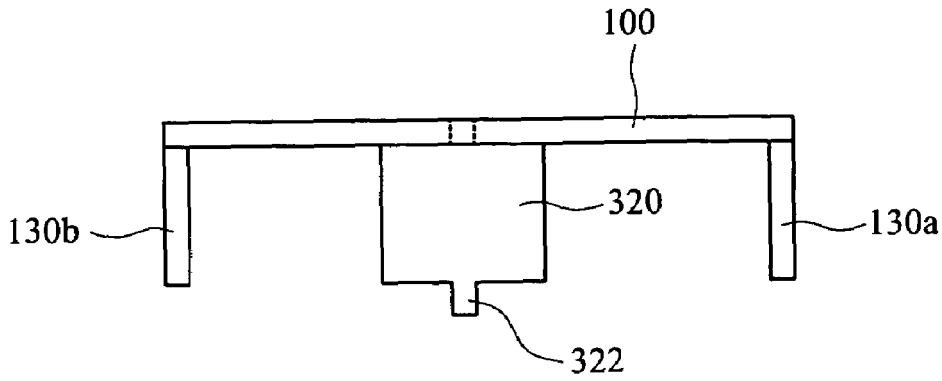
FIG. 4B is a schematic diagram showing the front view of the dual-band patch antenna, according to the second preferred embodiment of the present invention.
Figure 4C:
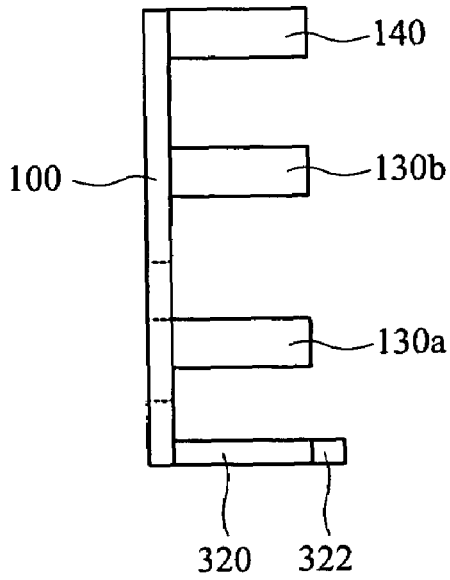
FIG. 4C is a schematic diagram showing the side view of the dual-band patch antenna with the slot structure, according to the second preferred embodiment of the present invention.

Referring to FIG. 1, FIG. 1 is a schematic diagram showing the 3-D view of a dual-band patch antenna with a slot structure, according to a first preferred embodiment of the present invention. The present invention is featured in providing a metal-work antenna including a rectangular (patch) radiator 100 on which an L-shaped slot structure 110 is formed; two shorting strips 130*a* a and 130*b* vertically shorted to a conductive ground plane (shot shown) formed on a base board 200; and a feeding means 120 inserted into the base board 200. Air or low dielectric-constant foam is filled on the space between the ground plane (the base board 200) and the rectangular radiator 100. Particularly, the dual-band patch antenna of the present invention can further include a support member 140 made of low dielectric-constant foam for reinforcing the support of the rectangular radiator 100. The connecting points F, S1, S2 and F of the rectangular radiator 100 for the feeding means 120, the first and second shorting strips 130*a* and 130*b*, and the support member 140 will be described in the below.

Referring to FIG. 1 and FIG. 2A to FIG. 2C, FIG. 2A to FIG. 2C are schematic diagrams respectively showing the top view, front view and side view of the dual-band patch antenna, according to the first preferred embodiment of the present invention. The rectangular radiator 100 has a first longer side 114*a*, a second longer side 114*b* parallel to the first longer side 114*a*, a first shorter side 116*a*, and a second shorter side 116*b* parallel to the first longer side 116*a*. The L-shaped slot structure 110 is composed of a first linear slot 112*a* and a second linear slot 112*b*, wherein one end of the first linear slot 112*a* is perpendicularly connected to the first shorter side 116*a*, and one end of the second linear slot 112*b* is perpendicularly connected to the other end of the first linear slot 112*a*, and the second linear slot 112*b* is located between the first linear slot 112*a* and the first longer side 114*a*. The feeding means 120 (such as a probe feed) is connected to a feed point F located on the rectangular radiator 100, wherein the feed point F is located on the first longer side 114*a* right below the second linear slot 112*b*, i.e. between the first longer side 114*a* and the other end of the second linear slot 112*b*. The first shorting strip 130*a* is connected to a first short point S1 located on the rectangular radiator 100, wherein the first short point S1 is located on the corner formed from the first shorter side 116*a* and the first linear slot 112*a*, and is between the second linear slot 112*b* and the first shorter side 116*a*, i.e. the first short point S1 is diagonally opposite to the feed point F. The second shorting strip 130*b* is connected to a second short point S2 located on the rectangular radiator 100, wherein the second short point S2 is adjacent to the second shorter side 116*b* with a predetermined distance L1 spaced from the first longer side 114*a*. It is noted that the predetermined distance L1 is about equal to the distance L2 between the second linear slot 112*b* and the second shorter side 116*b*, thereby increasing the bandwidths of the dual-band patch antenna so as to be applicable to IEEE802.11b/g/a/j or Bluetooth specifications. Further, the support member 140 is connected to the corner D formed from the first shorter side 116*a* and the second longer side 114*b*.

The size of the dual-band patch antenna according to the first preferred embodiment is quite small, and can meet the requirements of smallness, thinness, shortness and lightness. For example, the length of the first (or second) longer side 114*a* (or 114*b*) of the rectangular radiator 110 is about between 18 mm and 32 mm; the length of the first (or second) shorter side 116*a* (or 116*b*) is about between 15 mm and 29 mm. The predetermined distance L1 between the second short point S2 and the first longer side 114*a* is about between 9 mm and 17 mm. The height of the first shorting strip 130*a* and the second shorting strip 130*b* is about between 5 mm and 7 mm. The length of the second linear slot 112*b* is about smaller than the length of the first linear slot 112*a*, and the length of the first linear slot 112*a* is about smaller than or equal to one half of the length of the first longer side 114*a*, wherein the length of the first linear slot 112*a* is about between 15 mm and 29 mm. The distance L3 between the first linear slot 112*a* and the first longer side 114*a* is smaller than or equal to one half of the length of the first shorter side 116*a*, and is about between 5 mm and 9 mm. The width of the second linear slot 112*b* is smaller than the width of the first linear slot 112*a*, wherein the width of the first linear slot 112*a* is about between 1 mm and 3 mm. Therefore, the overall dimension of the dual-band patch antenna is quite small.

Referring to FIG. 3 and FIG. 4A to FIG. 4C, FIG. 3 and FIG. 2A to FIG. 2C are schematic diagrams respectively showing the 3-D view, the top view, front view and side view of the dual-band patch antenna, according to the first preferred embodiment of the present invention. In comparison with the first preferred embodiment, the second preferred embodiment is featured in providing a feeding means 320 having a fixing foot 322 used for being firmly inserted into the base board 200, wherein the cross-section of the fixing foot 322 is smaller than that of the feeding means 320, and the sharp tip of the fixing foot 322 is inserted into the base board 200, thereby enhancing the fixing force via a larger contact area between the base board 200 and the fixing foot 322. The fixing foot 322 of the present invention can be formed in various types. For example, the fixing foot 322 also can be formed in a beveled shape besides the shape shown in FIG. 4A.

It is worthy to be noted that the locations, sizes and materials of each of the components, and the locations of short and feed points mentioned above in the first and second preferred embodiments are merely stated for explanation, so that the present invention is not limited thereto.

From the test results, the dual-band patch antenna of the present invention is proved to have excellent antenna features, and can fully cover the bandwidths required by IEEE802.11b/g/a/j or Bluetooth specifications at about 2.45 GHz and 5.4 GHz.

Figure 5:
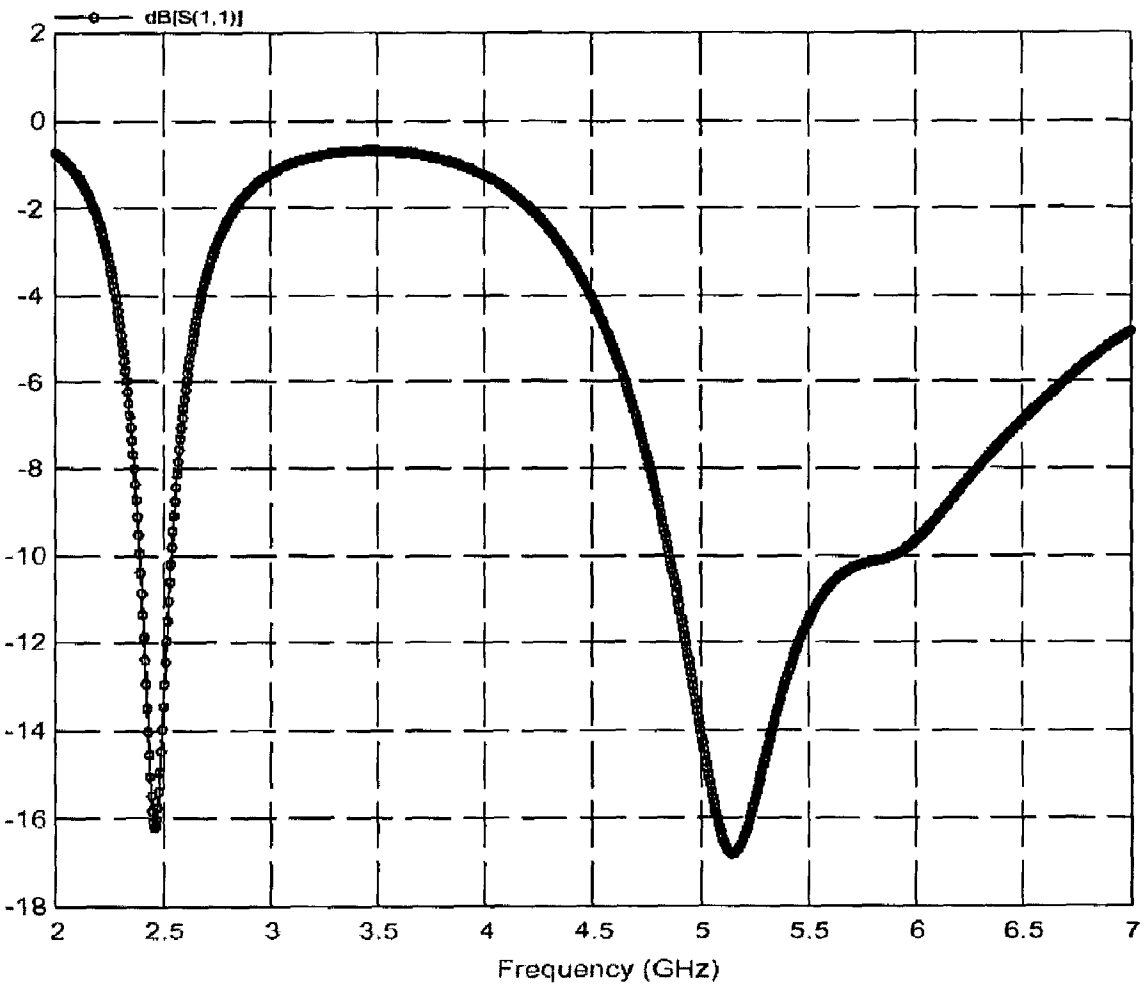
FIG. 5 is a diagram showing a simulation curve of return loss vs. frequency, according to the dual-band patch antenna of the second preferred embodiment of the present invention.

Referring FIG. 5, FIG. 5 is a diagram showing a simulation curve of return loss vs. frequency, according to the dual-band patch antenna of the second preferred embodiment of the present invention. Such as shown in FIG. 5, while being operated at about 2.45 GHz, the 10-dB frequency bandwidth of the dual-band patch antenna is greater than 100 MHz, and the maximum return loss is 24.978 dBi; while being operated at about 5.4 GHz, the 10-dB frequency bandwidth of the dual-band patch antenna is grater than 1000 MHz, and the maximum return loss is 20.724 dBi (at about 5.0 GHz).

Figure 6A:
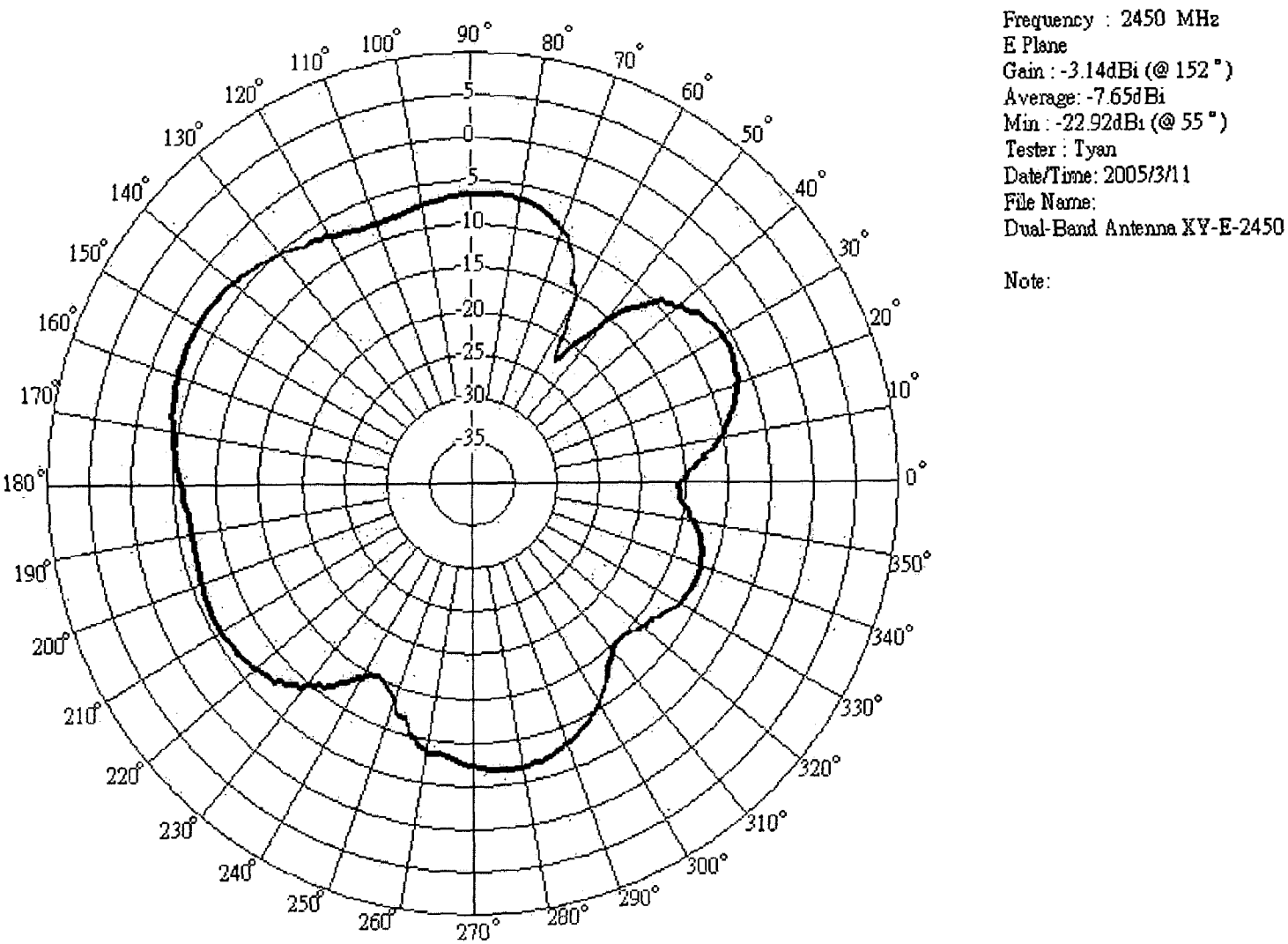
FIG. 6A is a diagram showing a radiation pattern in E plane when the dual-band patch antenna of the second preferred embodiment is operated at 2.45 GHz.
Figure 6B:
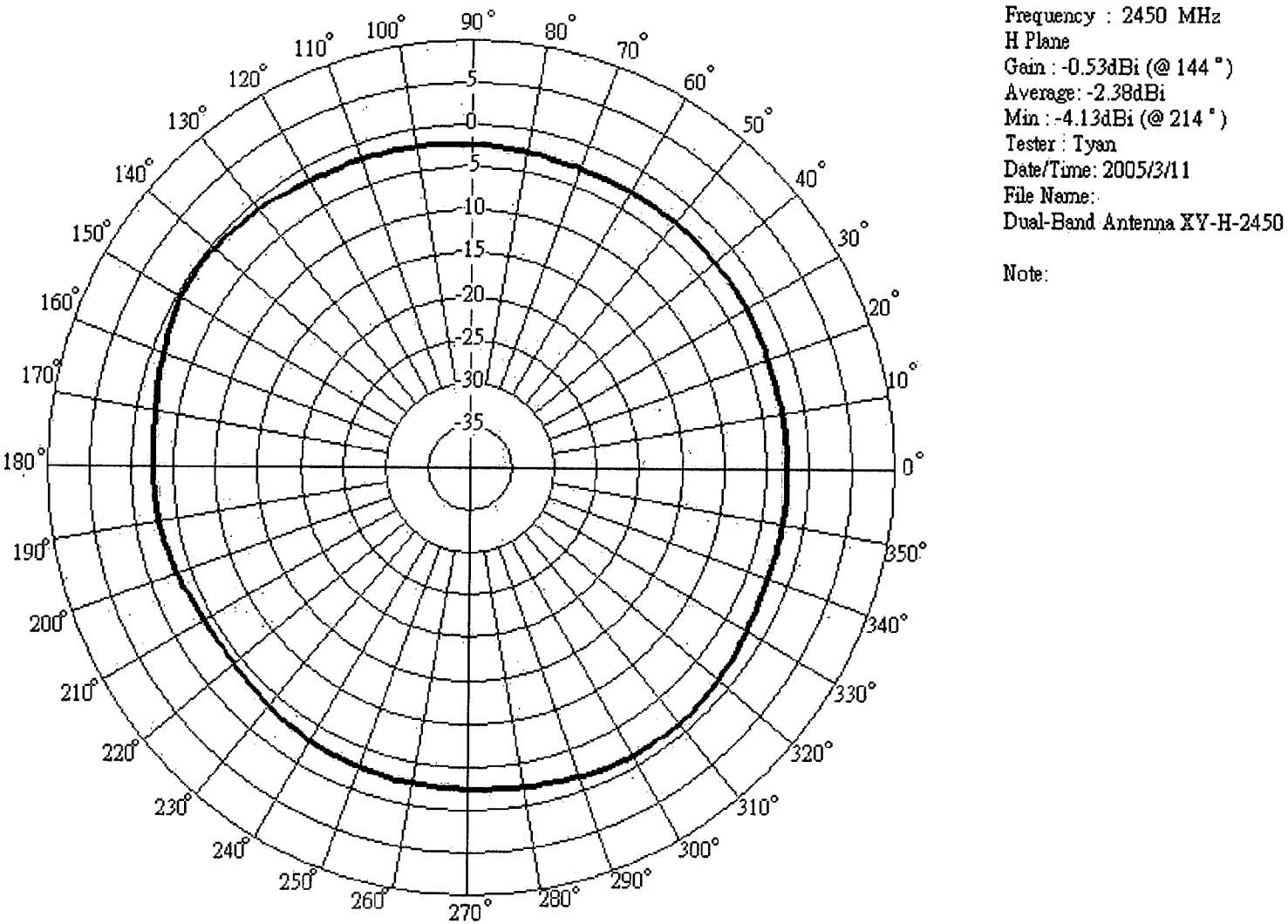
FIG. 6B is a diagram showing a radiation pattern in H plane when the dual-band patch antenna of the second preferred embodiment is operated at 2.45 GHz.
Figure 6C:
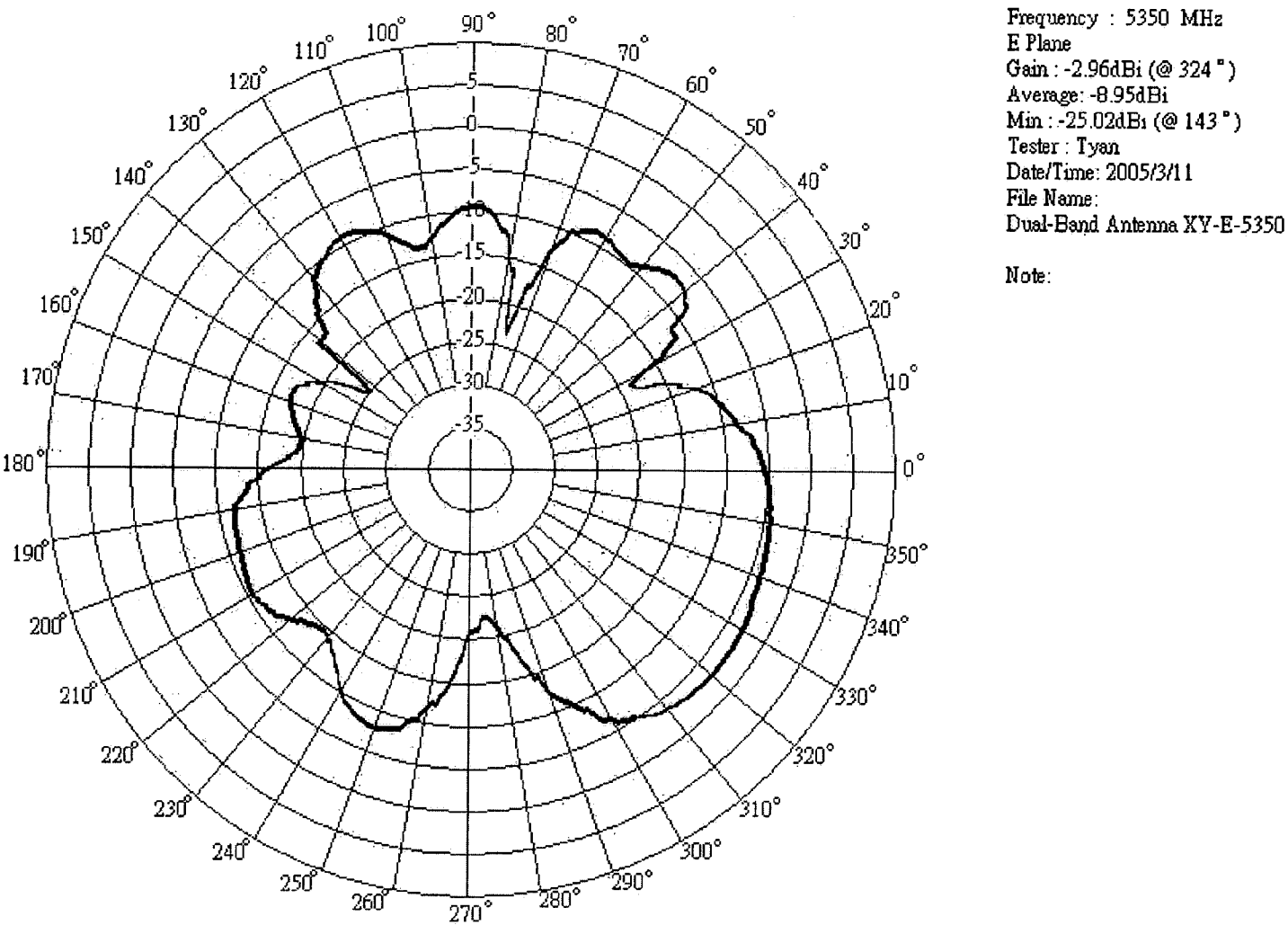
FIG. 6C is a diagram showing a radiation pattern in E plane when the dual-band patch antenna of the second preferred embodiment is operated at 5.35 GHz.
Figure 6D:
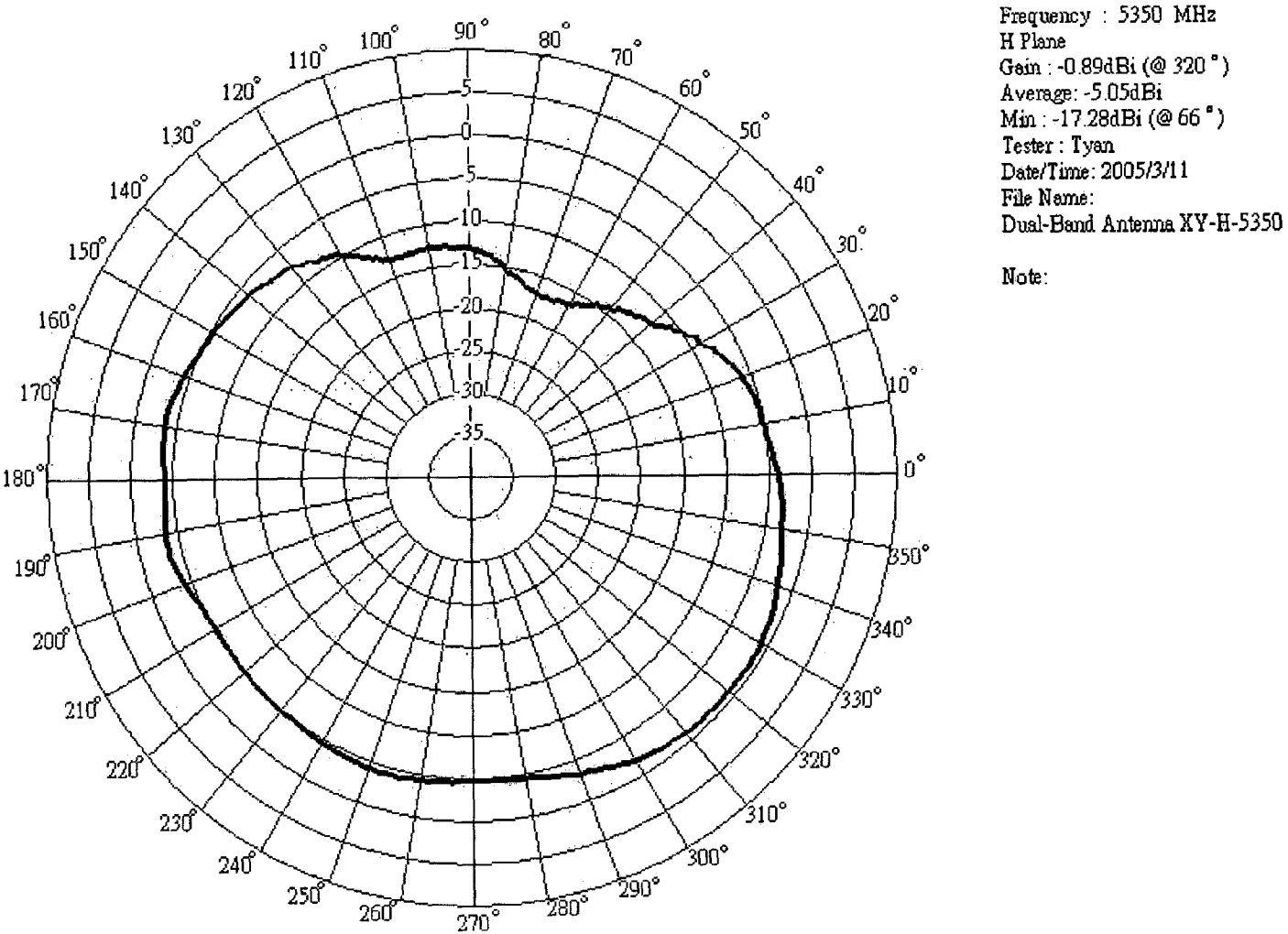
FIG. 6D is a diagram showing a radiation pattern in H plane when the dual-band patch antenna of the second preferred embodiment is operated at 5.35 GHz.

Referring FIG. 6A to FIG. 6D, FIG. 6A and FIG. 6B are diagrams showing radiation patterns respectively in E plane and H plane when the dual-band patch antenna of the second preferred embodiment is operated at 2.45 GHz; and FIG. 6C and FIG. 6D are diagrams showing radiation patterns respectively in E plane and H plane when the dual-band patch antenna of the second preferred embodiment is operated at 5.35 GHz. Accordingly, it can be known from FIG. 6A to FIG. 6D that the dual-band patch antenna of the second preferred embodiment demonstrates excellent radiation patterns at two central frequencies (2.45 GHz and 5.35 GHz), thus sufficiently satisfying user requirements.

Just as described in the aforementioned preferred embodiments of the present invention, the dual-band patch antenna of the present invention has the advantages of wide frequency range, simple structure, small size, and light weight.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A dual-band patch antenna with a slot structure, comprising:

a base board;

a rectangular radiator having a first longer side, a second longer side parallel to said first shorter side, a first shorter side, and a second shorter side parallel to said first longer side, wherein said slot structure is formed on said rectangular radiator, said slot structure having:

a first linear slot, wherein one end of said first linear slot is perpendicularly connected to said first shorter side; and a second linear slot, wherein one end of said second linear slot is perpendicularly connected to the other end of said first linear slot, and said second linear slot is located between said first linear slot and said first longer side;

a feeding means connected to a feed point located on said rectangular radiator, wherein said feeding means is inserted into said base board, and said feed point is located between said first longer side and the other end of said second linear slot;

a first shorting strip connected to a first short point located on said rectangular radiator, wherein said first short point is located on the corner formed from said first shorter side and said first linear slot, and is between said second linear slot and said first shorter side; and a second shorting strip connected to a second short point located on said rectangular radiator, wherein said second short point is adjacent to said second shorter side with a predetermined distance spaced from said first longer side, and said first shorting strip and said second shorting strip are electrically connected to a ground plane formed on said base board.

2. The dual-band patch antenna of claim 1, wherein said predetermined distance is substantially equal to the distance between said second linear slot and said second shorter side.

3. The dual-band patch antenna of claim 1, wherein said feeding means has a fixing foot used for being inserted into said base board, and the cross-section of said fixing foot is smaller than the cross-section of the feeding means.

4. The dual-band patch antenna of claim 1, wherein air is filled on the space between said ground plane and said rectangular radiator.

5. The dual-band patch antenna of claim 1, wherein low dielectric-constant foam is filled on the space between said ground plane and said rectangular radiator.

6. The dual-band patch antenna of claim 1, further comprising:

a support member connected to the corner formed from said first shorter side and said second longer side, wherein said support member is made of low dielectric-constant foam.

7. The dual-band patch antenna of claim 1, wherein the distance between said first linear slot and said first longer side is smaller than or equal to one half of the length of said first shorter side.

8. The dual-band patch antenna of claim 1, wherein the width of said second linear slot is smaller than the width of said first linear slot.

9. The dual-band patch antenna of claim 1, wherein the length of said first linear slot is substantially smaller than or equal to one half of the length of said first longer side.

10. A dual-band patch antenna with a slot structure, comprising:

a rectangular radiator having a first longer side, a second longer side parallel to said first longer side, a first shorter side, and a second shorter side parallel to said first shorter side, wherein said slot structure is formed on said rectangular radiator, said slot structure having:

a first linear slot, wherein one end of said first linear slot is perpendicularly connected to said first shorter side; and a second linear slot, wherein one end of said second linear slot is perpendicularly connected to the other end of said first linear slot, and said second linear slot is located between said first linear slot and said first longer side;

a feeding means connected to a feed point located on said rectangular radiator, wherein said feed point is located between said first longer side and the other end of said second linear slot, said feeding means having a fixing foot used for being inserted into a base board, and the cross-section of said fixing foot is smaller than the cross-section of the feeding means;

a first shorting strip connected to a first short point located on said rectangular radiator, wherein said first short point is located on the corner formed from said first shorter side and said first linear slot, and is between said second linear slot and said first shorter side; and a second shorting strip connected to a second short point located on said rectangular radiator, wherein said second short point is adjacent to said second shorter side with a predetermined distance spaced from said first longer side, and said predetermined distance is substantially equal to the distance between said second linear slot and said second shorter side.

11. The dual-band patch antenna of claim 10, wherein said first shorting strip and said second shorting strip are electrically connected to a ground plane formed on said base board.

12. The dual-band patch antenna of claim 11, wherein air is filled on the space between said ground plane and said rectangular radiator.

13. The dual-band patch antenna of claim 11, wherein low dielectric-constant foam is filled on the space between said ground plane and said rectangular radiator.

14. The dual-band patch antenna of claim 10, further comprising:

a support member connected to the corner formed from said first shorter side and said second longer side, wherein said support member is made of low dielectric-constant foam.

15. The dual-band patch antenna of claim 10, wherein the distance between said first linear slot and said first longer side is smaller than or equal to one half of the length of said first shorter side.

16. The dual-band patch antenna of claim 10, wherein the width of said second linear slot is smaller than the width of said first linear slot.

17. The dual-band patch antenna of claim 10, wherein the length of said first linear slot is substantially smaller than or equal to one half of the length of said first longer side.

* * * * *